US006240816B1

(12) United States Patent
Riedl et al.

(10) Patent No.: US 6,240,816 B1
(45) Date of Patent: Jun. 5, 2001

(54) DEPTH STOP FOR A HAND-HELD SCREW DRIVING TOOL

(75) Inventors: Reinhard Riedl, Finning; Horst Rahmsdorf, Munich; Manfred Ludwig, Landsberg, all of (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/458,856

(22) Filed: Dec. 10, 1999

(30) Foreign Application Priority Data

Dec. 14, 1998 (DE) ..... 198 57 563

(51) Int. Cl.[7] ..... B25B 23/00
(52) U.S. Cl. ..... 81/429; 81/54
(58) Field of Search ..... 81/429, 54; 7/138, 7/166

(56) References Cited

U.S. PATENT DOCUMENTS 2,940,488 * 6/1960 Riley, Jr. ..... 81/429
3,460,408 * 8/1969 Raymond ..... 408/112
4,199,833 * 4/1980 Sitkins et al. ..... 7/166
4,592,257 * 6/1986 Durr ..... 81/429
4,762,035 * 8/1988 Fushiya et al. ..... 81/429
5,389,099 * 2/1995 Hartmeister et al. ..... 606/61
5,524,512 * 6/1996 Wolfe ..... 81/429
5,682,800 * 11/1997 Jore ..... 81/429

* cited by examiner

*Primary Examiner*—James G. Smith
*Assistant Examiner*—Hadi Shakeri
(74) *Attorney, Agent, or Firm*—Brown & Wood, LLP

(57) ABSTRACT

A depth stop for a hand-held screw driving tool including a housing, a drive located in the housing for rotating a spindle about a spindle axis, and a chuck for receiving a working tool, connected with the housing and projecting from the housing in an axial direction defined by the spindle axis with the depth stop (3; 10; 16; 22) including a sleeve-shaped element for surrounding the chuck, connectable with the tool housing (2) and having at lease one axially extending opening formed in a wall of the sleeve-shaped element and piercing the wall through an entire wall thickness, and with the opening having, at its end remote from the housing (2) an entrance region (7; 21; 25) open in the axial direction.

9 Claims, 4 Drawing Sheets

DEPTH STOP FOR A HAND-HELD SCREW DRIVING TOOL

BACKGROUND OF THE INVENTION

1. Field of the Invention

The present invention relates to a depth stop for a hand-held screw driving tool including a housing, a drive located in the housing for rotating a spindle about a spindle axis, and a chuck for receiving a working tool, connected with the spindle and projecting from the housing in an axial direction defined by the spindle axis, with the depth stop including a sleeve-shaped element for surrounding the chuck, connectable with the tool housing and having means for adjusting a length of an axial projection of the depth stop past the chuck.

2. Description of the Prior Art

Gypsum plaster boards, flake boards, or fibrous plates are often directly connected, without preliminary drilling, to a constructional component or the like, e.g., a wooden component, a shaped sheet element or the like, by a hand-held screw driving tool and usable therewith, suitable attachment screws. At that, the constructional component, to which, e.g., a gypsum plaster board is to be attached, need be hit with the screw in order to correctly insert the same. During the attachment, as a rule, the screw is located high above the gypsum plaster board or the like. With improper attachment, the screw need be removed. Therefore, the operator need to carry gripping pliers with which the operator can pull out the screw after laying down the screw driving tool. Besides the necessity to carry the gripping pliers, the operator has to perform an additional operation which interrupts the production process. In addition, when working on a scaffold or the like, putting down the screw driving tool can present a problem.

The screw bits of the hand-held screw driving tools, which are used by professionals, are subjected to a rapid wear and, therefore, need be frequently replaced. For removing the screw bits from a bit holder secured in the chuck of the screw driving tool, a special gripping tool is needed, e.g., pliers with which the operator can grip the screw bit and pull it out of the bit holder. Often, the bit holder itself need be replaced. For this purpose, the operator has to have, as a rule, a separate auxiliary tool. The operator can either carry this auxiliary tool with him/her or interrupt the production process to procure the auxiliary tool. Of course, the interruption of the production process is highly undesirable.

The hand-held tool, as a rule, are equipped with a depth stop which provides for a controlled screwing-in and, e.g., in case of exposure of the attachment point to adverse weather conditions, permits a controlled pressing-on of a sealing washer provided on the fastening screw. With the known depth stops, the operator does not have any possibility to determined, during the setting process, when the sealing washer is placed on the constructional part and, as the case may be, whether it is overstrained by the operational process. As a result a uniform good quality of the attachment points cannot be insured. The pressing-on of the sealing washers cannot be controlled and can result in an inadequate sealing of the attachment points exposed to adverse weather conditions. The overstraining of the sealing washer can result in a sidewise displacement of the rubber coating. This adversely affects the appearance of the attachment points and can lead to reclamation on the part of the customer. Because of this, in many cases, the depth stop is not used. However, non-use of the depth stop, can result in formation of non-uniform and non-accessible attachment points. Furthermore, non-use of the depth stops results in increase of time necessary to form the attachment points.

Accordingly, an object of the present invention is to provide a depth stop in which the drawbacks of the prior art depth stops are eliminated.

Another object of the present invention is to provide a depth stop which would eliminate the need in separate gripping pliers or the like presently used for removing the improperly screwed-in screws from a gypsum plaster board and the like.

A further object of the present invention is to provide a depth stop which would eliminate a need in an auxiliary tool for removing the screw bits and, if necessary, for removing the bit holder.

A still further object of the present invention is to provide a depth stop which can be used with fastening screws provided with sealing washers without adversely affecting the quality of the formed attachment points.

SUMMARY OF THE INVENTION

These and other objects of the present invention, which will become apparent hereinafter, are achieved by providing a depth stop for a hand-held screw driving tool and including a housing, a drive located in the housing for rotating a spindle about a spindle axis, and a chuck for receiving a working tool, connected with the spindle and projecting from the housing in an axial direction defined by the spindle axis. The depth stop has a sleeve-shaped element for surrounding the chuck, connectable with the tool housing. The depth stop has at least one axially extending opening formed in a wall of the sleeve-shaped element and piercing the wall through an entire wall thickness. The opening has, at its axial end remote from the housing, an entrance region. The depth stop also has means for adjusting a length of an axial projection of the depth stop past the chuck. The at least one opening serves as an auxiliary means for removing an attachment or fastening screw, which permits to remove the screw with the screw driving tool itself. To this end, a screw head projecting above the upper surface of a gypsum plaster board or the like is guided through the entrance region of the axially extending opening into the opening, with the edges of the opening engaging the head from beneath. The screw is pulled out by moving the screw driving tool away from the construction part, i.e., the gypsum plaster board. Thus, there is no need in the gripping pliers, and the operator does need to carry them. Further, there is not necessary to put down the screw driving tool . Providing an opening having an appropriate shape permits to use the depth stop for removing screw bits from the bit holder. To this end, the depth stop need be disconnected from the housing. Thereafter, the screw bit can be clamped in the opening and pulled out. In the same way, the removal of the bit holder takes place. Because the opening pierces the wall through its entire thickness, it permits to control whether and when the sealing washer, which is provided on a screw, abuts the constructional part, e.g., the gypsum plaster board. Thus, there is no reason to remove the depth stop during screwing-in of screws provided with a sealing washer.

An easy guidance of a screw head into the opening is insured when the opening is formed as a slot guide and has at its end remote from the housing, a ramp-shaped entrance region. The screw head can be passed particularly easy through a ramp-shaped entrance region.

According to an advantageous embodiment of the present invention, the at least one opening has a large width at one of its axial ends than at the opposite end. This feature provides for holding of the screw, screw bit, and also the bit holder by clamping the screw, the screw bit or the bit holder in the opening, which permit an easy extraction of the screw, screw bit, or the bit holder.

Providing, according to the present invention, a plurality of piercing openings permits to provide openings having different geometry. This permits to use the depth stop for extraction of different types of fastening screws. In addition, providing a plurality of openings on the circumference of the depth stop permits to select the most appropriate position of the screw driving tool corresponding to respective space requirements for extraction of a particular screw which stipulate an easy grasping of the screw head from beneath.

According to a further advantageous embodiment of the present invention, the depth stop further includes at least one axially extending slot-shaped recess which pierces the wall through its entire thickness and the dimensions of which differ from those of the at least one opening. The slot-shaped recess forms an additional auxiliary mean for extraction, in particular, of screw bits and/or the bit holder.

Advantageously, the slot-shaped recess has a shape of a keyhole and has a circular widened region and a section conically tapering in the axial direction and adjoining the circular widened region. The screw bit, during its extraction, is clamped in the conical slot when being extracted from the bit holder. The circular widened region serves for removing the bit holder which projects from the chuck.

Because the at least one opening has its entrance end open in the axial direction at the front end of the depth stop, the operator has a clear view of the screw during the screwing-in process. Thereby, he/she can easily see when a sealing washer, when provided on the screw, abuts the constructional part. Therefore, the operator has no reason to effect the screw-in process without the depth stop. This provides a precondition for a particular function of a depth stop during the screwing-in of screws provided with sealing washers, namely, a controlled pressing-on of the sealing washer. In case when there are provided a plurality of openings, e.g., 3–4, distributed over the circumference of the depth stop and opening at the front end of the depth stop, an angular access is improved significantly.

According to a preferred embodiment of the invention, the at least one opening and the at least one recess are arranged one behind another in the axial direction, with the at least one opening being located closer to the housing than the at least one recess. This arrangement is particularly preferred when the sleeve-shaped element is formed of coaxially arranged one behind another a front sleeve and a rear threaded bushing arranged behind the front sleeve, with the front sleeve and the rear threaded bushing being preferably releasably connected by thread means. The at least one opening is formed in the rear threaded bushing which is fixedly but releasably connected with the housing, and the at least one recess is formed in the front sleeve.

The novel features of the present invention, which are considered as characteristic for the invention, are set froth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
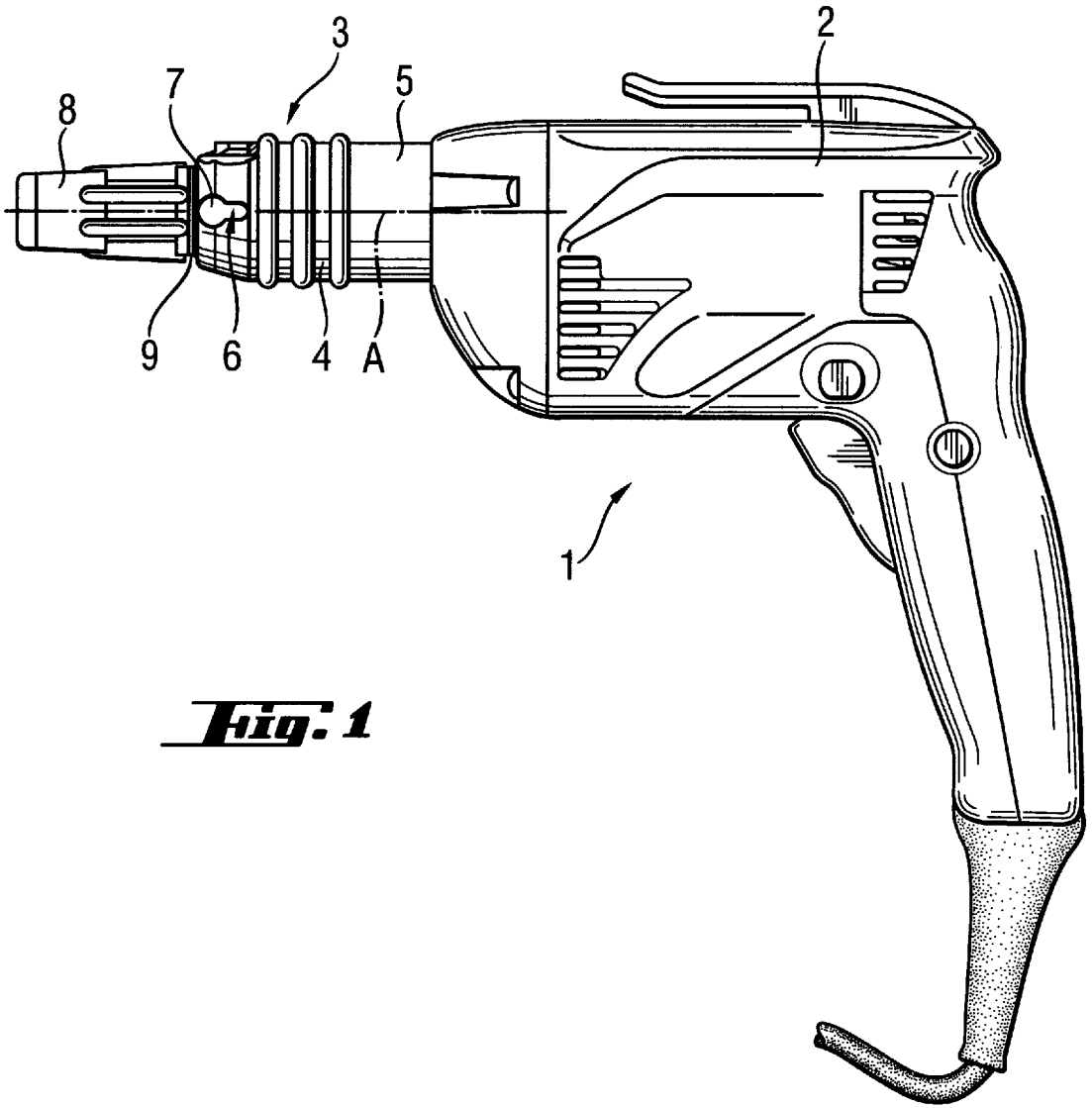
FIG. 1 a side elevational view of a screw driving tool with a depth stop according to the present invention.

A screw driving tool, which is shown in FIG. 1, is generally designated with a reference numeral 1. The screw driving tool 1 includes a gun-shaped tool housing 2 with a handle on which a trigger is provided. The power supply is effected through an electrical connecting cable. Inside the housing, there is provided an electric motor (not shown in detail) for driving a rotary spindle rotatable about a longitudinal axis A. In the axial extension of the rotary spindle, these is provided a tool chuck for receiving a working tool and which projects from the housing 2. The tool chuck is designed in particular for receiving of a bit holder for a screw bit. The screw driving tool described above is similar to a conventional screw driving tool known for a long time.

In FIG. 1, the tool chuck is surrounded with a depth stop 3 which can be formed, e.g., as a two-part member consisting of a rear threaded bushing 4 and a front sleeve 8. The rear threaded bushing 4 has a connection portion 5 which provides for connection of the threaded bushing 4 with the housing 2. For preferably releasable connection of the threaded bushing 4 with the housing 2, a threaded connection, a bayonet-type connection, or the like can be used. The front sleeve 8 has an outer thread 9 with which it is being screwed in the rear threaded bushing 4. The entire length of the depth stop 3 is adjusted, as needed, by screwing the front sleeve 8 into the threaded bushing 4 to greater or lesser degree. The function of the depth stop 3 is generally well known and at this stage need not be described in detail.

The threaded bushing 4 has, in its connection portion 5, an opening 6 formed in the bushing wall. The opening 6 extends in the direction of the axis A and extends through the wall completely. At its end remote from the housing 2, the. opening 6 has a somewhat drop-shaped widening entrance region, e.g., for a screw head.

Figure 2:
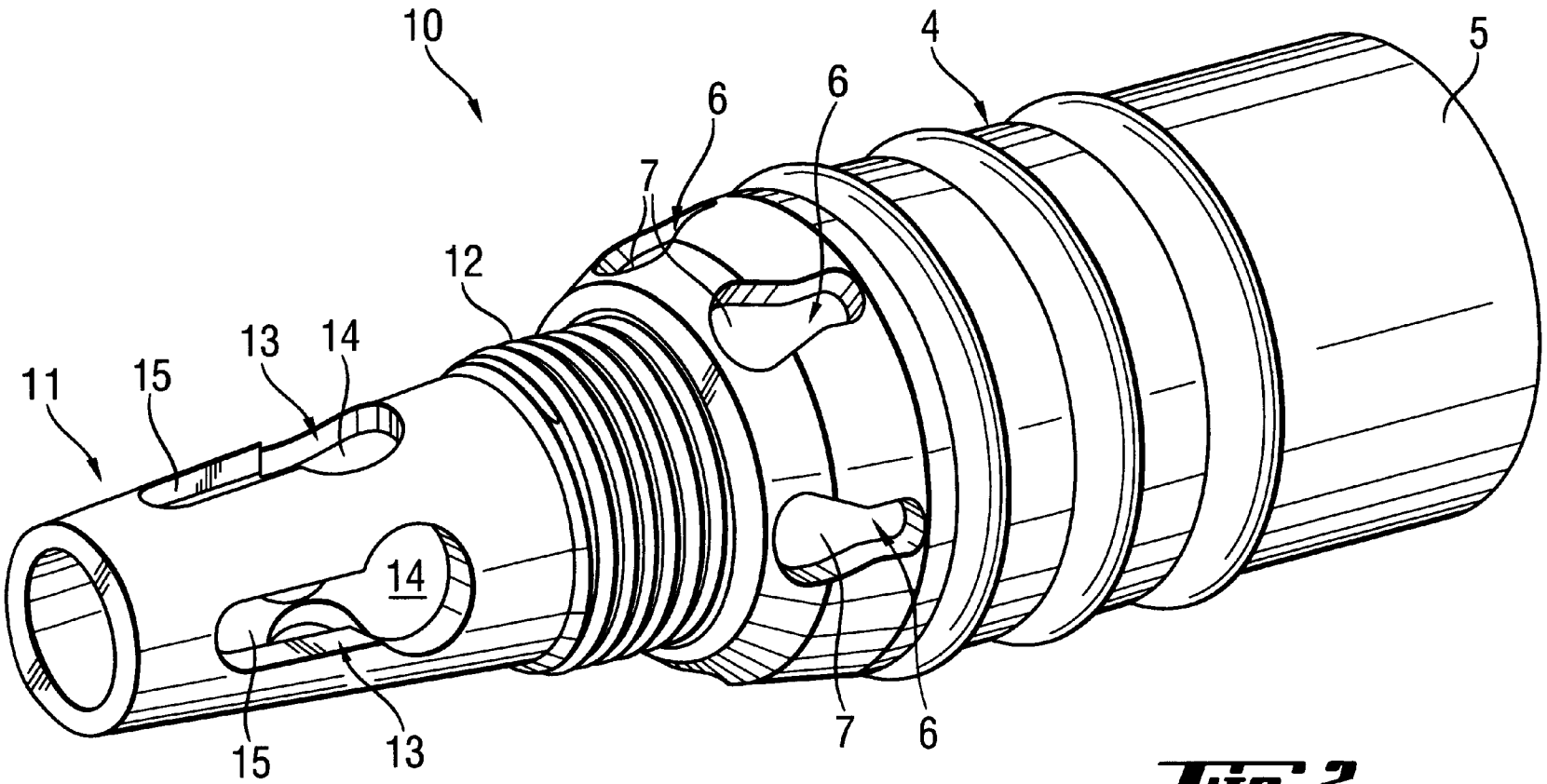
FIG. 2 a perspective view of a modified, in comparison with FIG. 1, depth stop according to the present invention.

An embodiment of a two-part depth stop, the rear threaded bushing 4 of which corresponds to the rear bushing 4 shown in FIG. 1, is shown in FIG. 2. As in FIG. 1, the bushing 4 shown in FIG. 2 has a connection portion, which is likewise designated with reference numeral 5, for connecting the bushing 4 with the tool housing 2. The opening which is formed in the wall of the threaded bushing 4 shown in FIG. 2, is designated with a reference numeral 6. The drop-shaped widened entrance region of the opening 6 is designated with a reference numeral 7. The drawing shows that the opening 6 with a drop-shaped widened entrance region 7 forms a slot guide for a pushed-in screw head. In the pushed-in condition, a screw head will be engaged from beneath by longitudinal edges of the slot guide. The screwed-in front sleeve is designated with a reference numeral 11. The front sleeve 11 has an outer thread 12 with which it is screwed into the rear bushing 4. In the wall of the front sleeve 11, there are provided a plurality of recesses 13 which extend in an axial direction. The recesses 13 are uniformly distributed over the circumference of the front sleeve 11. The recesses 13 have a somewhat circular widened region 14 which is adjoined by a conically tapering section 15. From place-saving considerations, the orientation shown in FIG. 2, where the circular widened region 14 is formed in the rear portion of the sleeve 11, and the conically tapering section 15 extends in the direction toward the front end of the sleeve 11, is preferable.

Figure 3:
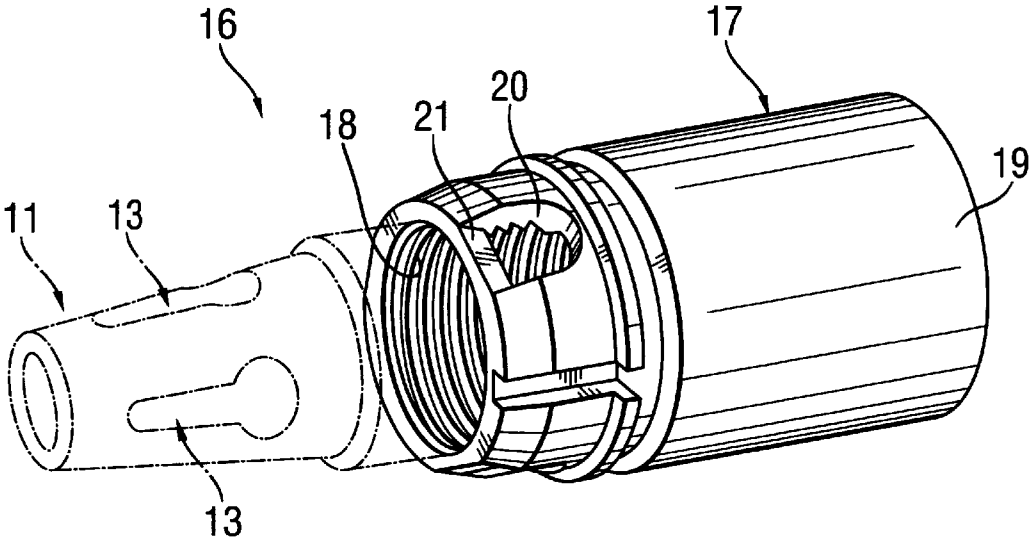
FIG. 3 a perspective view of the rear bushing of a modified two-part depth stop according to the present invention.

FIG. 3 shows a rear threaded bushing 17 of a modified embodiment of a two-part depth stop 16. The rear threaded bushing 17 has likewise a connection portion 19 with which the threaded bushing 17 is releasably connectable with the tool housing. At its front end, the threaded bushing 17 has an inner thread 18. The recess 20, which is formed in the front portion of rear threaded bushing 17 has a somewhat U-shaped contour. At its open front end, the recess 20 has a ramp-like entrance region 21 which facilitates the insertion a screw head.

Figure 4:
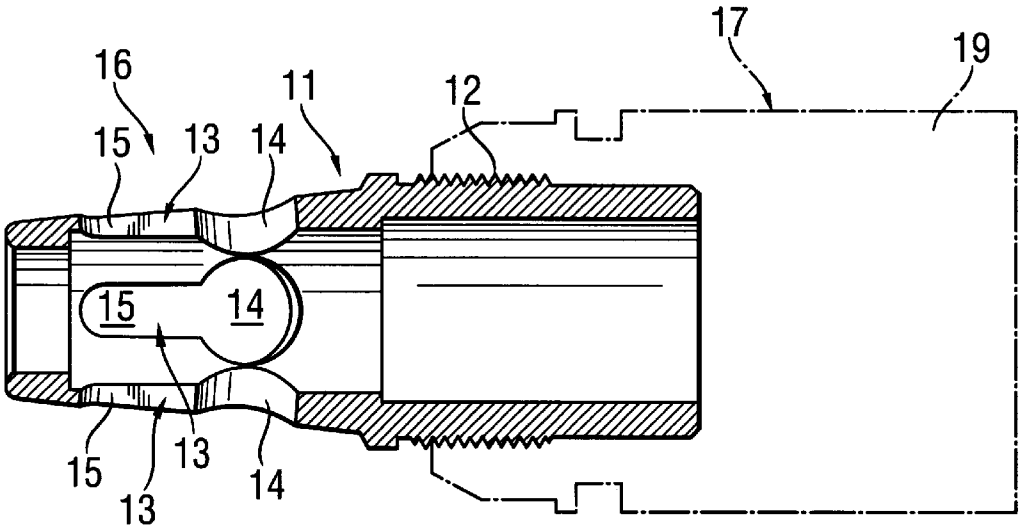
FIG. 4 a cross-sectional view of a front sleeve of the modified two-part stop according to the present invention.

The front sleeve 11 of the modified embodiment of a two-part depth stop 16, which is shown in FIG. 4, corresponds to the sleeve 11 shown in FIG. 2. The sleeve 11, which is shown in FIG. 4, has likewise an outer thread 12 which cooperates with the inner thread 18 of the rear threaded bushing 17 for connecting the front sleeve 11 with the rear threaded bushing 17. The front sleeve 11 likewise has a plurality of keyhole-shaped recesses 13 uniformly distributed over the circumference of the front sleeve 11. As in the front sleeve 11 shown in FIG. 2, each recess 13 has a circular widened region 14 which is adjoined by a conically tapering section 15 extending in the direction toward the front end of the sleeve 11. The conically tapering section 15 serves for clamping of a screw bit which in this manner can be easily pulled out with the depth stop 16 from a bit holder. The circular widened region 14 serves as an auxiliary pull-out means for the bit holder received in the tool chuck.

Figure 5:
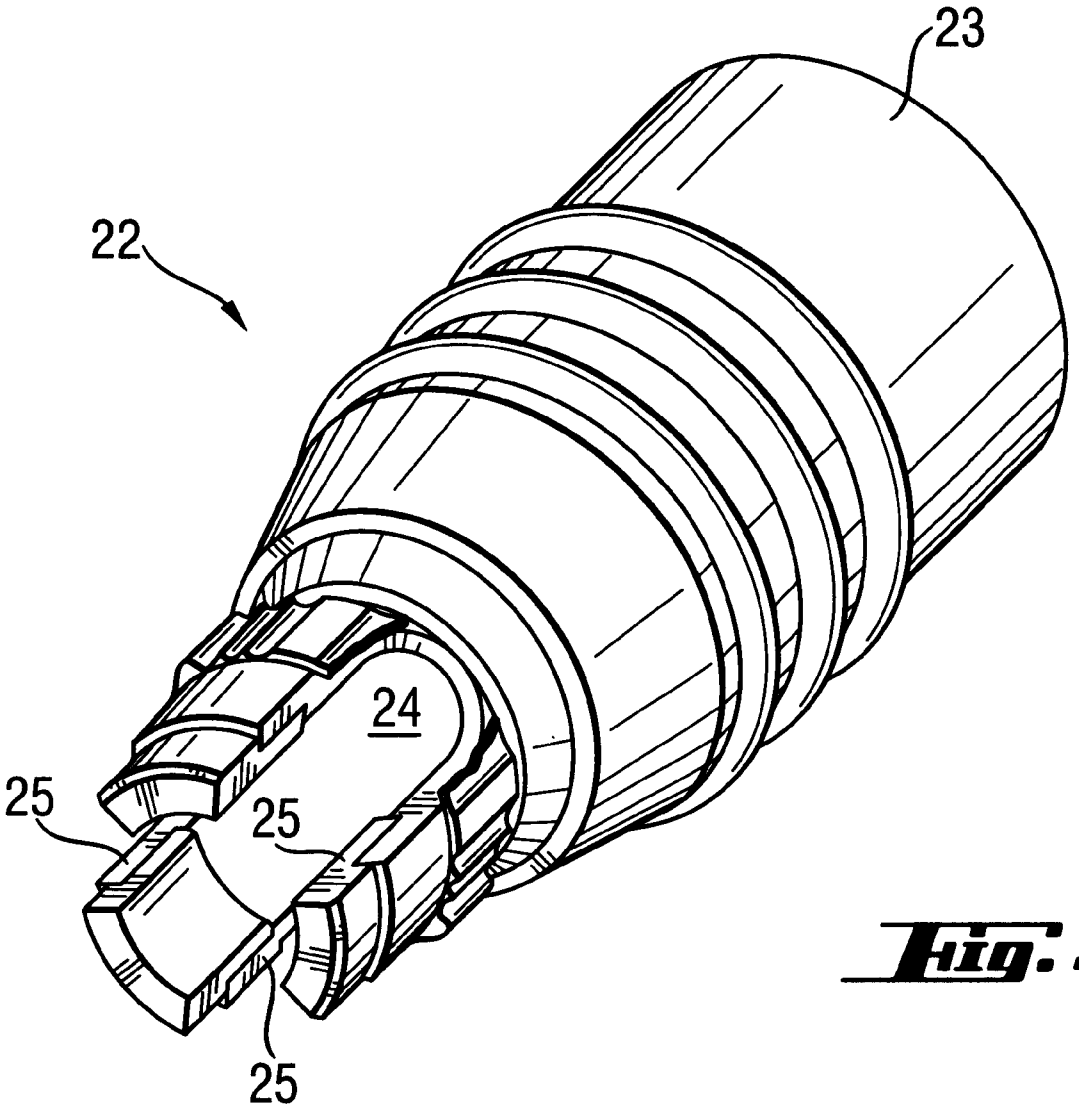
FIG. 5 a perspective view of another embodiment of a depth stop according to the present invention.

FIG. 5 shows another embodiment of a depth-stop generally designated with a reference numeral 22. The depth stop 22 can be formed off as a one-piece member or be formed of several parts. The depth stop 22 has, e.g., three openings 24 which completely pierced the wall of the depth stop 22. The openings 24 are open at their ends at the front end of the depth stop 22. The open mouths of the openings 24 form an entrance region 25. The openings 24 can conically taper in the axial direction. At the axially opposite end stop 22 has a connection portion 23 which provides for a releasable connection of the depth stop 22 with the tool housing. To provide for the adjustment of a length of an axial projection of the depth stop 22, the connection portion 23 can be provided with an outer thread cooperating with an inner thread provided in the housing (2).

Though the present invention has been shown and described with reference to a preferred embodiment, such is merely illustrative of the present invention and is not to be construed as to be limited to the disclosed embodiment and/or details thereof, and the present invention includes all modifications, variations and/or alternate embodiments within the spirit and scope of the present invention as defined by the appended claims.

What is claimed is:

1. A depth-stop for a hand-held screw driving tool comprising a housing, a drive located in the housing for rotating a spindle about a spindle axis, and a chuck for receiving a working tool connected with the spindle and projecting from the housing in an axial direction defined by the spindle axis, the depth stop comprising a sleeve-shaped element for surrounding the chuck, connectable with the tool housing and having at least one axially extending opening formed in a wall of the sleeve-shaped element and piercing the wall through an entire wall thickness, the opening having, at an axial end thereof remote from the housing, an entrance region having a width larger than a width of the opening at an opposite axial end thereof; and means for adjusting a length of an axial projection of the depth stop past the chuck.

2. A depth stop according to claim 1, further comprising means for releasably connecting the depth stop (3; 10; 16; 22) with the tool housing (2).

3. A depth stop according to claim 1, wherein the at least one opening (6; 20) has a slot guide shape, and wherein the entrance region (7; 21) is formed as a ramp.

4. A depth stop according to clam 1, comprising a plurality of axially extending openings (6; 20) distributed over a circumference of the sleeve-shaped element and having each, at an axial end thereof remote from the housing, an entrance region having a width larger than a width of the opening at opposite axial end thereof.

5. A depth-stop for a hand-held screw driving tool, comprising a housing, a drive located in a housing for rotating a spindle about a spindle axis, and a chuck for receiving a working tool connected with the spindle and projecting from the housing in an axial direction defined by the spindle axis, the depth stop comprising a sleeve-shaped element for surrounding the chuck, connectable with the tool housing and having at least one axially extending opening formed in a wall of the sleeve-shaped element and piercing the wall through an entire wall thickness, the opening having, at an axial end thereof remote from the housing, an entrance region having a width larger than a width of the opening at opposite axial end thereof; means for adjusting a length of an axial projection of the depth stop past the chuck; and at least one axially extending slot-shaped recess which pierces the wall through an entire thickness of the wall and has at least one of width and length different from width and length of the at least one opening, respectively, wherein the slot-shaped recess has a shape of a keyhole having a circular widened region and a section conically tapering in the axial direction and adjoining the circular widened region.

6. A depth stop according to claim 5, comprising a plurality of axially extending slot-shaped recesses (13) distributed over a circumference of the sleeve-shaped element and each of which pierces an entire thickness of the wall and has at least one of width and length different from width and length of the at least one opening (6; 20), and wherein each of the slot-shaped recesses (13) has a shape of a keyhole having a circular widened region (14) and a section (15) conically tapering in the axial direction and adjoining the circular widened region (14).

7. A depth-stop according to claim 5, wherein the at lease one opening (6; 20) and the at least one recess (13) are arranged one behind another in the axial direction, with the at lease one opening (6;20) being located closer to the housing (2) than the at least one recess (13).

8. A depth-stop according to claim 7, wherein the sleeve-shaped element comprises coaxially arranged one behind another front sleeve (11) and a rear threaded bushing (4; 14), wherein the at least one opening (6; 20) is formed in the rear threaded bushing (4; 17) and the at least one recess (13) is formed in the front sleeve (13), and wherein the adjusting means comprises thread means for releasably connecting the front sleeve (11) with the rear threaded bushing (4; 17).

9. A depth-stop for a hand-held screw driving tool, comprising a housing, a drive located in the housing for rotating a spindle about a spindle axis, and a chuck for receiving a working tool connected with the spindle and projecting from the housing in an axial direction defined by the spindle axis, the depth stop comprising a sleeve-shaped element for surrounding the chuck, connectable with the tool housing and having at least one axially extending opening formed in a wall of the sleeve-shaped element and piercing the wall through an entire wall thickness, the opening having, at an axial end thereof remote from the housing, an entrance region open at a front end of the depth stop; and means for adjusting a length of an axial projection of the depth stop past the chuck.

* * * * *